United States Patent [19]

Chen

[11] Patent Number: 4,523,123

[45] Date of Patent: Jun. 11, 1985

[54] CATHODE-RAY TUBE HAVING ASYMMETRIC SLOTS FORMED IN A SCREEN GRID ELECTRODE OF AN INLINE ELECTRON GUN

[75] Inventor: Hsing-Yao Chen, Landisville, Pa.

[73] Assignee: RCA Corporation, Princeton, N.J.

[21] Appl. No.: 492,044

[22] Filed: May 6, 1983

[51] Int. Cl.[3] ..... H01J 29/51; H01J 29/56

[52] U.S. Cl. ..... 313/412; 313/414

[58] Field of Search ..... 313/412, 414, 413

[56] References Cited

U.S. PATENT DOCUMENTS

| | | | |
|---|---|---|---|
| B 381,074 | 1/1975 | Hasker et al. | 313/448 |
| 3,772,554 | 11/1973 | Hughes | 313/412 |
| 3,886,081 | 2/1975 | Hasker et al. | 313/449 |
| 4,234,814 | 11/1980 | Chen et al. | 313/412 |
| 4,241,275 | 12/1980 | Yamauchi | 313/413 |
| 4,242,613 | 12/1980 | Brambring et al. | 313/447 |
| 4,251,747 | 2/1981 | Burdick | 313/348 |
| 4,272,700 | 6/1981 | Collins | 313/458 |
| 4,319,163 | 3/1982 | Chen | 315/14 |

FOREIGN PATENT DOCUMENTS

| | | | |
|---|---|---|---|
| 2097577 | 11/1983 | United Kingdom | 313/413 |

OTHER PUBLICATIONS

U.S. patent application Ser. No. 461,584 filed on Jan. 27, 1983 by H. Y. Chen.

U.S. patent application Ser. No. 492,437 filed on May 6, 1983 entitled, "Cathode-Ray Tube Having an Asymmetric Slot Formed in a Screen Grid Electrode of an Inline Electron Gun", filed concurrently herewith by F. van Hekken et al.

*Primary Examiner*—Palmer Demeo

*Attorney, Agent, or Firm*—Eugene M. Whitacre; Dennis H. Irlbeck; Vincent J. Coughlin, Jr.

[57] ABSTRACT

An inline electron gun for a cathode-ray tube includes a plurality of cathodes, a control grid, a screen grid and a main focus lens arranged successively in alignment with the cathodes for focusing a plurality of electron beams onto a screen. The screen grid has a given thickness with a plurality of transverse slots formed therein. The slots have a depth less than the thickness of the screen grid. An aperture is formed in each of the slots. The outer slots are asymmetric with respect to the apertures therein and are displaced transversely toward the center aperture. The transverse slots in the screen grid compensate for the vertical flare distortion of the beam spot at off-center positions on the screen and the asymmetric location of the outer slots reduces the horizontal convergence sensitivity of the outer beams with respect to focus voltage change.

8 Claims, 8 Drawing Figures

CATHODE-RAY TUBE HAVING ASYMMETRIC SLOTS FORMED IN A SCREEN GRID ELECTRODE OF AN INLINE ELECTRON GUN

BACKGROUND OF THE INVENTION

This invention relates to cathode-ray tubes, and particularly to color cathode-ray tubes of the type useful in home television receivers and color display tubes, and to electron guns therefor.

The invention is especially applicable to self-converging tube-yoke combinations with shadow mask tubes of the type having plural-beam inline guns disposed in a horizontal plane, an apertured mask with vertically oriented slit-shaped apertures, and a screen with vertically oriented phosphor stripes. The invention is not, however, limited to use in such tubes and may, in fact, be used, e.g., in dot-type shadow mask tubes and index-type tubes.

An inline electron gun is one designed to generate at least two, and preferably three, electron beams in a common plane and to direct the beams along convergent paths to a small area spot on the screen. A self-converging yoke is one designed with specific field nonuniformities which automatically maintain the beams converged throughout the raster scan.

In one type of inline electron gun, such as that shown in U.S. Pat. No. 3,772,554, issued to R. H. Hughes on Nov. 13, 1973, the main electrostatic focusing lenses for focusing the electron beams are formed between two electrodes referred to as the first and second accelerating and focusing electrodes. These electrodes include two cup-shaped members having the bottoms of the members facing each other. Three apertures are included in each cup bottom to permit passage of three electron beams and to form three separate main focus lenses, one for each electron beam. In such electron guns, static convergence of the outer beams with respect to the center beam is usually attained by offsetting the outer apertures in the second focusing electrode with respect to the outer apertures in the first focusing electrode.

It has been noted that the horizontal beam landing locations of the outer electron beams, in color picture tubes having the above-described electron gun, change with changes in the focus voltage applied to the electron gun. It therefore is desirable to improve such inline electron gun to eliminate, or at least reduce, this horizontal convergence sensitivity to focus voltage changes.

Additionally, there has been a general trend toward inline color picture tubes with greater deflection angles (angles in excess of 90°) in order to provide shorter tubes. In such tubes, it has been found that the electron beams become excessively distorted as they are scanned toward the outer portions of the screen. Such distortions are commonly referred to as flare and appear on the screen of the tube as an undesirable low intensity tail or smear extending from a desirable intense core or spot. Such flare distortions are due, at least in part, to the effects of the fringe portions of the deflection field of the yoke on the beam as it passes through the electron gun, and to the nonuniformities in the yoke deflection field itself.

When the yoke's fringe field extends into the region of the electron gun, as is usually the case, the beams may be deflected slightly off axis and into a more aberrated portion of an electron lens of the gun. The result is frequently a flare distortion of the electron beam spot which extends from the spot toward the center of the screen. This condition is particularly troublesome in self-converging yokes having a toroidal vertical deflection coil, because of the relatively strong fringing of toroidal type coils.

Self-converging yokes are designed to have a nonuniform field in order to increasingly diverge the beams as the horizontal deflection angle increases. This nonuniformity also causes vertical convergence of the electrons within each individual beam. Thus, the beam spots are overconverged at points horizontally displaced from the center of the screen, causing a vertically extending flare both above and below the core of the beam spot.

The vertical flare due to both the effects of the yoke's fringe field in the region of the gun and to the nonuniform character of the yoke field itself is an undesirable condition which contributes to poor resolution of a displayed image on the edge and corners of the screen.

Copending U.S. patent application Ser. No. 461,584, filed on Jan. 27, 1983 to H-Y. Chen and assigned to the assignee of the present invention, discloses a screen grid structure shown in FIG. 8 of the copending application for simultaneously reducing both the sensitivity of the inline electron gun to focus voltage changes and the vertical flare distortion of the electron beam spot. The disclosed screen grid structure utilizes rectangular slots formed in the surface of the screen grid electrode facing the control grid electrode. The slots are aligned with the apertures in the screen grid to create an astigmatic field that produces underconvergence of the electron beam in the vertical plane only, to compensate for the vertical flare distortion. Such a slot structure is described in U.S. Pat. No. 4,234,814, issued to H-Y. Chen et al. on Nov. 18, 1980. The screen grid structure disclosed in the copending Chen patent application also utilizes a pair of reconvergence slots formed on the first accelerating and focusing electrode side of the screen grid electrode. The reconvergence slots are formed closely to and inwardly from the outer apertures in the screen grid electrode and cause a refraction of the electrostatic beam path between the screen grid electrode and the first accelerating and focusing electrode to compensate for the offset refraction within the main lens of the electrode gun. The copending Chen application disclosed a screen grid structure which requires forming two sets of slots on opposite sides of the screen grid electrode. Such a structure is expensive and difficult to manufacture. Thus, a structure which corrects both vertical flare and sensitivity to focus voltage change and is easily and inexpensively produced is desired.

SUMMARY OF THE INVENTION

An inline electron gun for a cathode-ray tube includes a plurality of cathodes, a control grid, a screen grid and electron lens means arranged successively in alignment with the cathodes for focusing a plurality of electron beams onto a screen. The screen grid has a given thickness with a plurality of depressions formed therein. The depressions have a depth less than the thickness of the screen grid. An aperture is formed in each of the depressions, and the depressions are asymmetric with respect to the apertures therein.

DETAILED DESCRIPTION OF THE PREFERRED EMBODIMENTS

Figure 1:
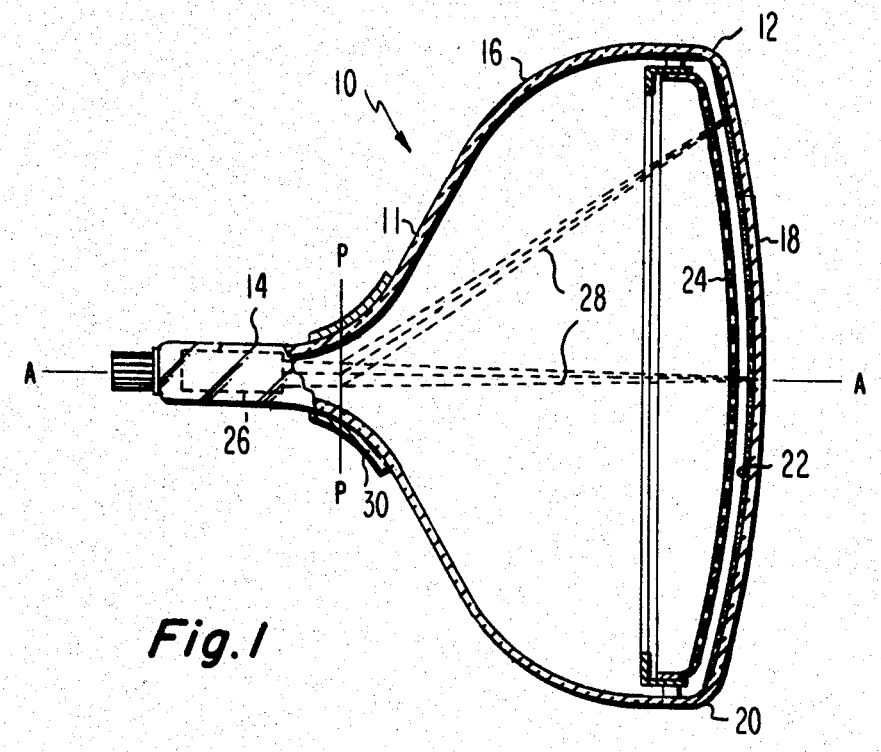
FIG. 1 is a plan view, partly in axial section, of a shadow mask cathode-ray tube embodying the present invention.

FIG. 1 is a plan view of a rectangular color cathode-ray tube 10 having a glass envelope 11 comprising a rectangular faceplate panel or cap 12 and a tubular neck 14 connected by a rectangular funnel 16. The panel comprises a viewing faceplate 18 and peripheral flange or sidewall 20 which is sealed to the funnel 16. A three-color phosphor screen 22 is carried by the inner surface of the faceplate 18. The screen 22 is preferably a line screen with the phosphor lines extending substantially perpendicular to the high frequency raster line scan of the tube (normal to the plane of FIG. 1). Alternatively, the screen could be a dot screen as is known in the art. A multiapertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along spaced coplanar convergent paths through the mask 24 to the screen 22.

The tube of FIG. 1 is designed to be used with an external magnetic deflection yoke, such as the yoke 30 schematically shown surrounding the neck 14 and funnel 16 in the neighborhood of their junction. A YAM (Yoke Adjusting Machine, not shown) is utilized to precisely adjust the yoke 30 on the tube 10. The tube is operated during the YAM operation with an optimum focus voltage in order to obtain the desired adjustment. Adjusting the yoke 30 horizontally with respect to the electron beams increases the width and height of the raster generated by one of the outer beams while reducing the width and height of the other outer beam raster. A vertical yoke motion causes a raster rotation of the outer beams; one beam rotates clockwise and the other rotates counterclockwise. After adjustment, the yoke is held in position on the tube using, for example, a hot-melt adhesive. When activated, the yoke 30 subjects the three beams 28 to vertical and horizontal magnetic flux which causes the beams to scan horizontally and vertically, respectively, in a rectangular raster over the screen 22. The initial plane of deflection (at zero deflection) is shown by the line P—P in FIG. 1 at about the middle of the yoke 30. For simplicity, the actual curvature of the deflection beam paths in the deflection zone is not shown in FIG. 1. A readjustment or change in focus voltage from the optimum focus voltage used during the above-described YAM operation changes the focus voltage - ultor voltage ratio of the electron gun and results in a change in the relative strength or focal length of the main electrostatic focus lens with a resulting misconvergence of the outer beams relative to the center beam.

Figure 2:
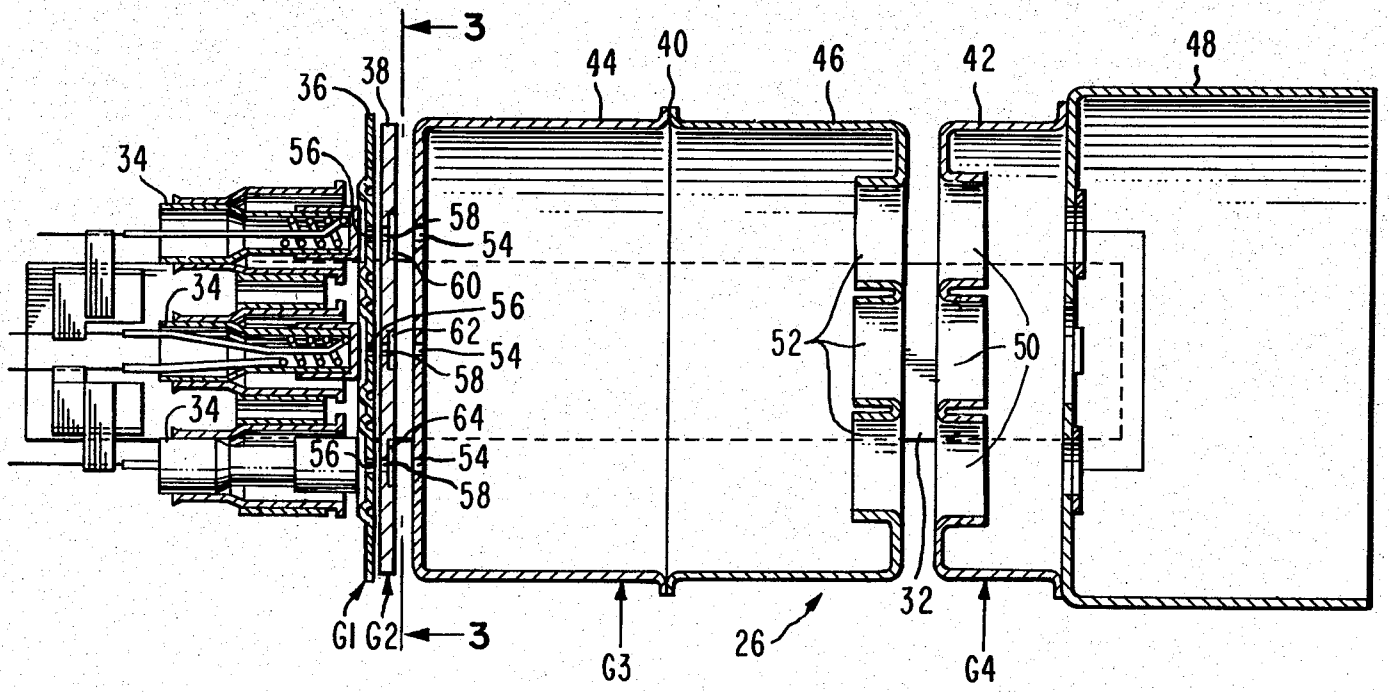
FIG. 2 is a partial axial section view of the electron gun shown in dashed lines in FIG. 1.

The details of the improved electron gun 26 are shown in FIG. 2. The gun comprises two glass support rods 32 (one shown) on which various electrodes are mounted. These electrodes include three equally spaced coplanar cathode assemblies 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. All of the post-cathode electrodes have at least three inline apertures in them to permit passage of three coplanar electron beams. The main electrostatic focusing lens in the gun 26 is formed between the G3 electrode 40 and the G4 electrode 42. The G3 electrode 40 is formed with two cup-shaped elements 44 and 46, the open ends of which are attached to each other. The G4 electrode 42 also is cup-shaped, but has its open end closed with a shield cup 48. The portion of the G4 electrode 42 facing the G3 electrode 40 includes three inline apertures 50, the outer two of which are slightly offset outwardly from corresponding apertures 52 in the G3 electrode 40. The purpose of this offset is to cause the outer electron beams to converge with the center electron beam. However, misconvergence can occur if the focus voltage on the G3 electrode 40 is changed significantly from the optimum focus voltage utilized during the YAM operation described above. The side of the G3 electrode 40 facing the G2 electrode 38 includes three apertures 54 which are aligned with apertures 56 in the G1 electrode 36 and with apertures 58 in the G2 electrode 38.

Figure 3:
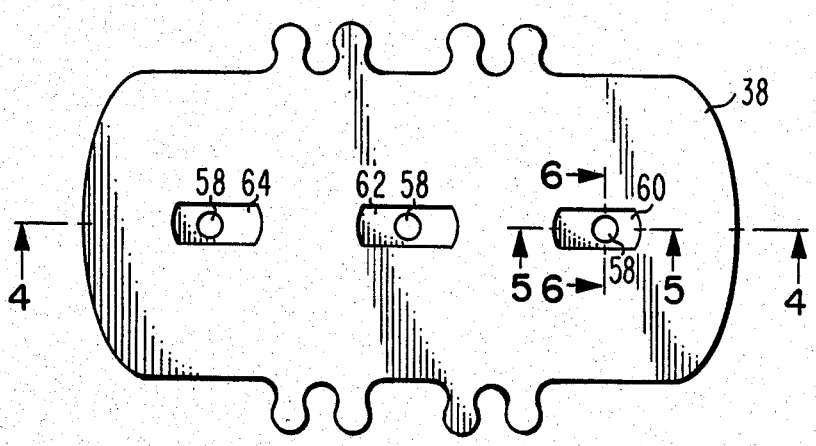
FIG. 3 is an enlarged elevational view taken along line 3—3 of FIG. 2, of the novel G2 electrode of the electron gun.
Figure 4:
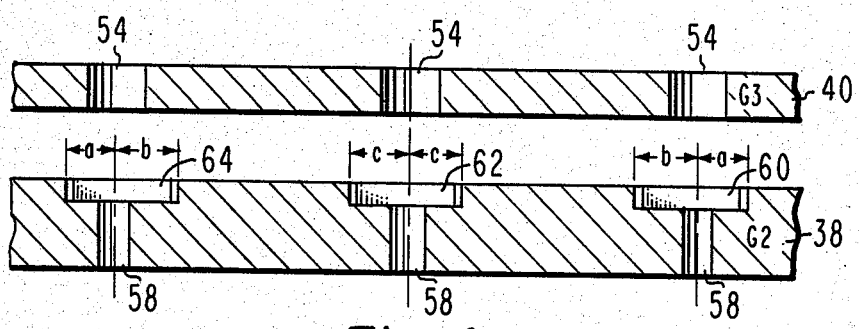
FIG. 4 is an enlarged sectional view of portions of the G2 and G3 electrodes of the electron gun, taken along the line 4—4 of FIG. 3.

FIGS. 3, 4, 5 and 6 illustrate in detail a portion of the beam forming region of the electron gun 26. As shown in FIGS. 2, 3 and 4, the G2 electrode 38 includes three transverse, horizontally disposed slots 60, 62 and 64 formed in the G3 side of the G2 electrode. An aperture 58 is formed in each of the slots 60, 62 and 64. The outer slots 60 and 64 are asymmetrically formed relative to the apertures 58 included therein and are displaced transversely toward the center aperture 58. In FIG. 4, it can be seen that the center slot 62 in the G2 electrode 38 is symmetrically disposed in a horizontal transverse direction about the central aperture 58 such that the distance "c" from the edge of the slot to the center line of the center aperture 58 is equal for both sides of the slot 62. The balanced electrostatic field created by the slot 62 will not disturb the electron beam passing through the center aperture. However, the outer slots 60 and 64 are asymmetrically displaced transversely toward the center aperture such that slot dimension, "b", is greater than slot dimension, "a".

In the preferred embodiment, the apertures 58 have a diameter of about 0.64 mm (25 mils) and are transversely spaced apart a distance of 6.60 mm (260 mils), center-to-center. The slots 60, 62 and 64 each have a length of about 2.54 mm (100 mils) and a width of about 1.27 mm (50 mils). The G2 electrode 38 has a thickness of about 0.71 mm (28 mils), and each of the slots 60, 62 and 64 has a depth of about 0.20 mm (8 mils). The outer slots 60 and 64 are displaced about 0.13 mm (5 mils) transversely toward the center aperture 58. In order to further reduce vertical flare, the longitudinal ends of the slots 60, 62 and 64 are arcuately shaped and have a radius of about 1.27 mm (50 mils) measured from the center of the slots. The ratio of slot depth to slot width in the preferred embodiment is about 0.16 and may range from about 0.15 to 0.30.

Figure 5:
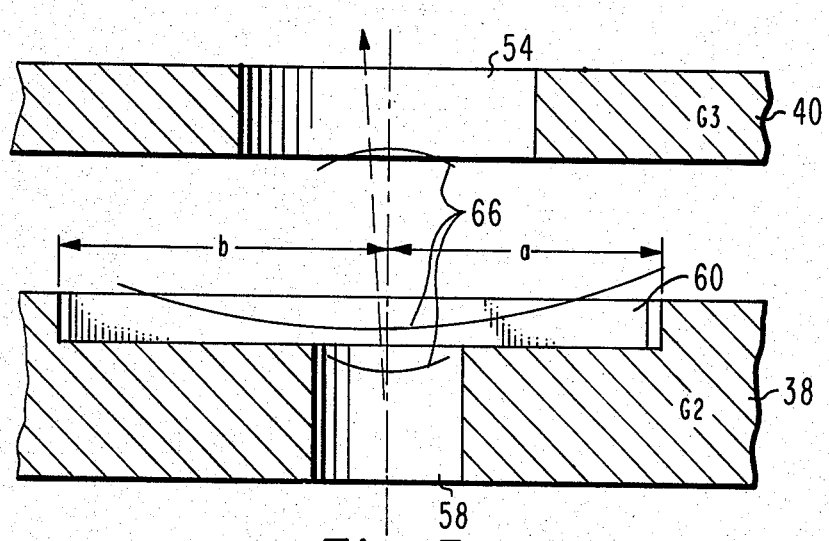
FIG. 5 is an enlarged section, taken along line 5—5 of FIG. 3, illustrating formation of the electron beam in a horizontal plane.
Figure 6:
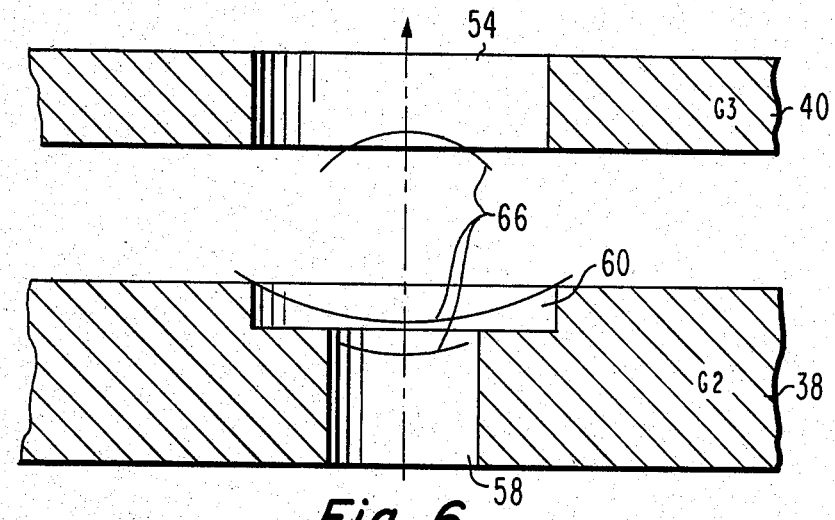
FIG. 6 is an enlarged section, taken along line 6—6 of FIG. 3, illustrating formation of the electron beam in a vertical plane.

As illustrated in FIG. 5, the electrostatic equipotential field lines 66 extend between the G2 screen grid 38 and the G3 accelerating and focusing electrode 40 of the electron gun 26. The transverse displacement of the slot 60 to the left toward the center aperture 58 causes a slight tilt of the field lines 66 within the slot 60 and causes the outer electron beam to horizontally converge toward the center electron beam passing through the center aperture (not shown). A similar but oppositely directed shift toward the center beam occurs to the electron beam passing through the oppositely disposed outer aperture 58 due to the distortion of the field lines 66 induced by the transversely displaced slot 64.

The horizontal convergence of the two outer electron beams causes the electron beams to enter the main focusing lens at a slight angle rather than straight on. Since the slots 60, 62 and 64 are symmetric with respect to the apertures 58 in the vertical direction, see, e.g., FIG. 6, the electrostatic equipotential field lines 66 are symmetrical in the vertical direction with respect to the apertures 58. However, the curvature of the field lines 66 is sharper in the vertical direction because the slot width is less than the slot length, thus, the vertical focus field is stronger than the horizontal focusing field. It has been found that the horizontal convergence of the outer electron beams as the beams approach the main focus lens reduces the horizontal sensitivity of the outer electron beams with respect to focus voltage changes. The strong vertical convergence of the three electron beams reduces vertical flare.

While the invention is described in the embodiment of a bipotential electron gun having an aperture spacing of 6.60 mm (260 mils), center-to-center, the invention can be utilized in other electron guns having a different aperture spacing, such as about 5.00 mm (less than 200 mils), as described in U.S. patent application Ser. No. 343,734, filed Jan. 29, 1982 by A. M. Morrell et al., entitled, "Color Image Display Ssytems", and assigned to the same assignee as the present invention.

Figure 7:
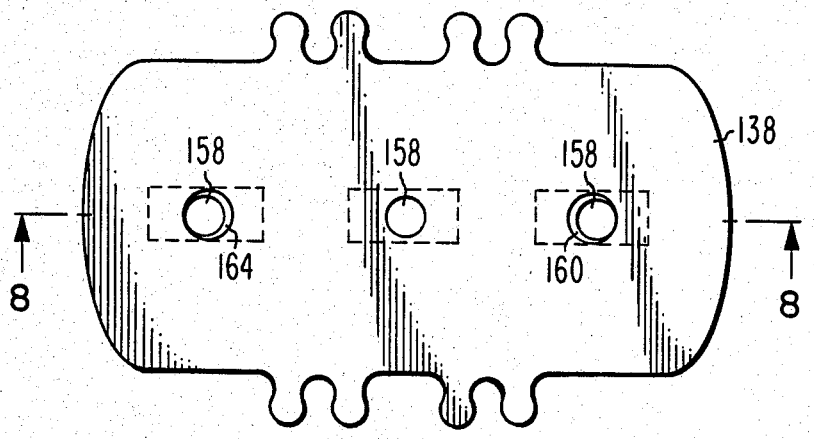
FIG. 7 is an enlarged elevational view of a second embodiment of the novel G2 electrode of the electron gun.
Figure 8:
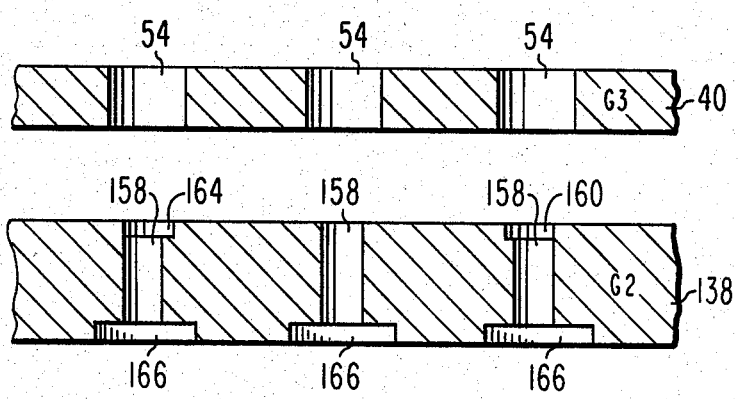
FIG. 8 is an enlarged sectional view of portions of the G2 and G3 electrodes of the electron gun taken along line 8—8 of FIG. 7.

A second embodiment of the novel G2 screen grid is shown in FIGS. 7 and 8. The G2 electrode 138 has three apertures 158 therethrough, which are aligned with the apertures 54 in the G3 electrode 40. Two circular depressions 160 and 164 are formed asymmetrically about the outer apertures 158 on the G3 side of the G2 electrode 138. The G2 electrode 138 in this embodiment has a thickness of about 0.51 mm (20 mils). The apertures 158 have a diameter of about 0.64 mm (25 mils), and the depressions 160 and 164 have a diameter of about 0.76 mm (30 mils) and a depth of about 0.13 mm (5 mils). The depressions 160 and 164 are displaced about 0.06 mm (2.5 mils) toward the center aperture 158. The circular depressions 160 and 164 reduce the horizontal sensitivity of the outer beams with respect to focus voltage change less strongly than do the asymmetric slots 60 and 64 but provide no compensation for vertical flare. However, if the deflection angle of the tube does not exceed 90°, vertical flare is negligible and flare reduction is not required. Vertical flare compensation can be achieved in tubes having large deflection angles by providing rectangular slots 166 in the surface of the G2 electrode, which faces the G1 electrode (not shown). The slots 166 are aligned with the apertures 158 and create an astigmatic field which produces underconvergence of the electron beams in the vertical plane only, to compensate for the vertical flare distortion at off-center positions of the image screen. When the rectangular slots 166 are utilized, the G2 electrode thickness is increased to about 0.71 mm (28 mils). The rectangular slots 166 have a depth of about 0.20 mm (8 mils) and are disclosed in U.S. Pat. No. 4,234,814 issued to Chen et al., on Nov. 18, 1980 and incorporated herein for the purpose of disclosure.

GENERAL CONSIDERATIONS

The electron gun 26 is designed to operate with an ultor potential ranging from about 25 to 30kV applied to electrode 42 (G4) and about 7 to 8.5kV applied to electrode 40 (G3). Appropriate voltages are applied to the electrode 36 (G1) and the electrode 38 (G2). During the YAM operation described above, the G3–G4 voltages are optimized to converge the outer electron beams and the center beam at the shadow mask 24; however, if the G3–G4 voltage ratio is varied, i.e., by changing the G3 focus voltage relative to the G4 voltage, misconvergence occurs. If, for example, the G3 focus voltage is made more positive, the G3–G4 main focus lens is weakened and the outer beams tend to misconverge outwardly. At the same time, the increase in G3 focus voltage relative to the G2 screen grid voltage strengthens the G2–G3 lens action. The outer slots 60,64 formed asymmetrically inward of outer beam apertures 58 strongly distort the electrostatic field formed between the screen grid electrode (G2) 38 and the first accelerating and focusing electrode and tend to converge the outer beams toward the center beam as the beams pass through the apertures in the G2 electrode. The outer slots 60,64 thus compensate for the misconvergence that occurs within the main focus lens.

Likewise, if the G3 focus voltage is made less positive, the G3–G4 main focus lens is strengthened, and the outer beams tend to converge inwardly. Simultaneously, the decrease in G3 focus voltage relative to the G2 screen grid voltage weakens the G2–G3 lens action. The outer slots 60,64 distort the electrostatic field less strongly so that the outer beams tend to misconverge outwardly from the center beam after the beams pass through the apertures in the G2 electrode. The net effect is that the asymmetric slots provide a compensating field between the G2–G3 electrodes which offsets any changes in the main focus lens, i.e., between the G3–G4 electrodes, caused by focus voltage variations.

What is claimed is:

1. In a cathode-ray tube comprising an image screen and an in-line electron gun for projecting three electron beams onto said screen, said gun comprising:

three cathodes for generating said electron beams, a control grid, a screen grid, and a main electron lens arranged successively in alignment with said cathodes for focusing said electron beams, said control grid and said main electron lens having three apertures disposed in a plane for passing said electron beams, said screen grid having a given thickness with three transverse slots formed therein facing said main electron lens, said slots having a depth less than the thickness of said screen grid, said screen grid having an aperture within each of said slots, the improvement wherein the outer slots are asymmetric with respect to the aperture therein, each of said outer slots being displaced transversely toward said center aperture.

2. The tube as defined in claim 1, wherein each of said slots has a substantially rectangular shape.

3. The tube as defined in claim 1, wherein said slots have a length of about 2.54 mm and a width of about 1.27 mm.

4. The tube as defined in claim 3, wherein the longitudinal ends of said slots have an arcuate shape with a radius of about 1.27 mm measured from the center of said slot.

5. The tube as defined in claim 4, wherein the outer slots are displaced toward the center aperture by about 0.13 mm.

6. The tube as defined in claim 1, wherein said slots have a depth of about 0.20 mm.

7. The tube as defined in claim 1, wherein said slots have a depth to width ratio ranging from about 0.15 to 0.30.

8. An astigmatic grid electrode for a cathode-ray tube in-line electron gun comprising a functional grid portion having a given thickness, three transverse slots including a center slot and two outer slots formed in said functional grid portion, each of said slots lying in a plane and having a depth less than that of said given thickness, said grid electrode having three apertures therein, each of said apertures communicating with a different one of said slots, the outer slots being asymmetric with respect to the apertures communicating therewith, each of said outer slots being displaced transversely toward said center aperture.

* * * * *